US011192744B2

(12) United States Patent
Frische et al.

(10) Patent No.: US 11,192,744 B2
(45) Date of Patent: Dec. 7, 2021

(54) APPARATUS AND METHOD FOR CHANGING A REEL AND CONNECTING A NEW MATERIAL WEB TO AN END OF AN OLD MATERIAL WEB

(71) Applicant: Windmöller & Hölscher KG, Lengerich (DE)

(72) Inventors: Holger Frische, Lengerich (DE); Gerd Kasselmann, Lengerich (DE); Tim Kirchhoff, Lengerich (DE); Peter Strunk, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 311 days.

(21) Appl. No.: 16/069,472

(22) PCT Filed: Jan. 18, 2017

(86) PCT No.: PCT/EP2017/050982
§ 371 (c)(1),
(2) Date: Jul. 11, 2018

(87) PCT Pub. No.: WO2017/125436
PCT Pub. Date: Jul. 27, 2017

(65) Prior Publication Data

US 2019/0016550 A1 Jan. 17, 2019

(30) Foreign Application Priority Data

Jan. 18, 2016 (DE) ..... 102016200570.7

(51) Int. Cl.
*B65H 19/18* (2006.01)

(52) U.S. Cl.
CPC ..... *B65H 19/1821* (2013.01); *B65H 19/1863* (2013.01); *B65H 19/1894* (2013.01);
(Continued)

(58) Field of Classification Search
CPC ..... B65H 19/1821; B65H 19/1894; B65H 19/1863; B65H 2301/4623; B65H 2301/46075; B65H 2301/46072
See application file for complete search history.

(56) References Cited

U.S. PATENT DOCUMENTS 3,654,035 A * 4/1972 Takimoto ..... B29C 66/1142 156/505
3,939,031 A * 2/1976 Takimoto ..... B29C 66/83513 156/505

(Continued)

OTHER PUBLICATIONS

Williams et al., Means for generating a controlled butt splice gap, Not known, Mason Publications, Hampshire, GB, Bd. 201, Nr. 9, Jan. 1, 1981.

(Continued)

*Primary Examiner* — William A. Rivera
(74) *Attorney, Agent, or Firm* — Bret E. Field; Bozicevic, Field & Francis LLP

(57) ABSTRACT

The invention relates to a device for changing a reel and for connecting a new material web to the end of an old material web, with a first reel (101) from which the first material web thereof which is wound thereon can be unwound, a transport device (103), particularly a transport roller, by means of which the first material web can be guided in a guiding region at a transport speed, a second reel (121) with which the new material web can be prepared, a drive device for rotatably driving the second reel, a separating device (142) for cutting through the first material web, by means of which the material web can be cut through in the guiding region or upstream of the guiding region in order to produce a trailing end, and a control and/or regulating device for the mutual adjustment of the trailing end and the beginning (125) of the second material web, such that the trailing end and the beginning of the web are at a distance of more than 0 mm (Continued)

Figure 1:
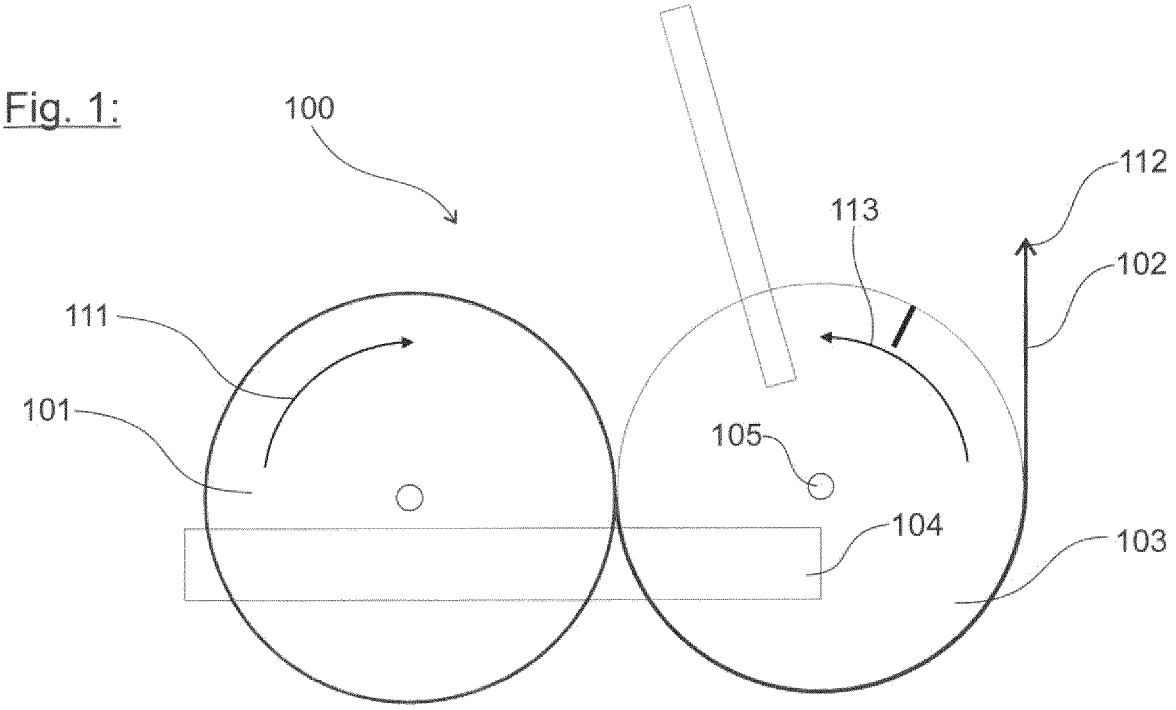

from each other and particularly do not overlap. The trailing end and the beginning of the new material web can be connected to each other in the guiding region of the transport device by means of a connection element, and the transport speed of the trailing end and the beginning of the web corresponds to more than 0 meter per minute in the guiding region.

13 Claims, 4 Drawing Sheets

(52) U.S. Cl.
CPC ..... *B65H 2301/4623* (2013.01); *B65H 2301/46072* (2013.01); *B65H 2301/46075* (2013.01)

(56) References Cited

U.S. PATENT DOCUMENTS 3,939,032 A * 2/1976 Taitel ..... B65H 19/1852 156/505
4,097,323 A * 6/1978 De Roeck ..... B65H 19/1836 156/159
4,120,739 A * 10/1978 Peeters ..... B29C 65/5042 156/506
5,772,150 A * 6/1998 Spatafora ..... B65H 19/1836 156/504
5,881,964 A * 3/1999 Fujikura ..... B65H 19/1836 156/505
5,900,090 A 5/1999 Distefano et al.
6,247,515 B1 * 6/2001 Spatafora ..... B65H 19/1836 156/304.3
6,701,992 B1 * 3/2004 Pasquale ..... B65H 21/00 156/304.1
6,792,987 B2 * 9/2004 Monroe ..... B65H 19/1852 156/351
6,893,531 B1 * 5/2005 Todaro ..... B65H 21/00 156/304.1
10,457,512 B2 * 10/2019 Pasquale ..... B65H 21/00
2004/0060641 A1 4/2004 Ward et al.
2004/0084561 A1 * 5/2004 Clifford ..... B65H 23/032 242/552
2010/0090052 A1 4/2010 Müller
2014/0131504 A1 * 5/2014 Ramteke ..... B65H 19/102 242/556.1
2014/0251528 A1 9/2014 Cederholm et al.
2018/0079614 A1 * 3/2018 Pasquale ..... B65H 19/102

OTHER PUBLICATIONS

Notification of Transmittal of Translation of the International Preliminary Report on Patentability dated Aug. 2, 2018, for PCT/EP2017/050982, 7 pages.

* cited by examiner

APPARATUS AND METHOD FOR CHANGING A REEL AND CONNECTING A NEW MATERIAL WEB TO AN END OF AN OLD MATERIAL WEB

The invention relates to an apparatus and a method for unwinding a material web.

Material webs needed for a further treatment process in a further processing machine are often supplied in the form of a roll. This material web is then unwound from the roll in an unwinding apparatus. If the material web stock on this roll is approaching the end, a new roll must be introduced into the unwinding apparatus. In order not to have to introduce the web start of this new roll separately into the further processing machine, the web start is attached to the trailing web end of the first roll. Even during the roll change, the further processing machine should be able to operate as efficiently as possible. In addition, it may also be necessary that the attachment point causes no malfunctions in the further processing machine.

It is therefore the object of the present invention to provide an apparatus and a method with which a further processing machine can be operated as efficiently and as trouble-free as possible.

This object is achieved by the features of claim 1.

Accordingly, an apparatus for changing a roll and for connecting a web start of a new material web to an end of an old material web is provided, comprising:

- A first roll, whose wound-up, first material web can be unwound;
- a conveying device, in particular a conveying roller, via which the first material web may be guided in a guiding area at conveying speed;
- A second roll, with which the new material web may be supplied;
- A drive device for rotationally driving the second roll;
- A separator for severing the first material web, with which the material web can be severed in order to create a trailing end in the guiding area or upstream of the guiding area;
- A control and/or regulating device for mutual adjustment of the trailing end and the web start, such that the trailing end and the web start are at a distance greater than 0 mm from one another, and in particular free of overlap;
- Whereby the trailing end and a web start of the new material web in the guiding area of the conveying device may be connected to one another with a connecting element; and
- Whereby the conveying speed of the trailing end and the web start in the guiding area exceeds 0 meters per minute.

The material web wound on the first roll is therefore situated in the unwinding apparatus, in particular in a first unwinding position. The roll is thereby preferably rotatably drivable by a drive in order to simplify unwinding. The material web may subsequently be conveyed via a conveying device, in particular a conveying roller, whereby the material web generally does not cover the complete conveying surface, but only a part thereof, for a conveying roller, e.g., a cylinder segment. This area can generally be referred to as a guiding area. The material web is thus conveyed at conveying speed. The conveying device may be spaced away from the roll or be in direct contact with the outer layer of the roll.

In order to change the roll, a second roll, with which the new material web may be supplied, is then advanced to the unwinding apparatus. This roll may then be situated in a second unwinding position. Alternatively, the first roll may be brought into a second unwinding position and the second roll may be introduced into the first winding position of the unwinding apparatus. In the unwinding position, the roll is movable within the unwinding apparatus. Furthermore, a drive, with which the roll is rotatably drivable, is included. In particular, the roll can be accelerated and also braked by the drive, whereby a separate brake may be provided for braking, as an option or additionally.

To perform the actual change of the material web, a separator is provided with which a trailing end of the first material web can be created. This separator acts on the material web in the guiding area or before it. "Before" or "upstream" refers to a position which, when viewed in the conveying direction, lies between the first roll and the conveying device. It is thereby preferred that the separation apparatus be immobile relative to the material web, at least at the moment of the separation process, i.e., it moves independently at the conveying speed of the material web.

In addition, a control and/or regulating device is provided for mutual adjustment or positioning of the trailing end and the web start of a new material web. Advantageously, the new roll and/or new material web can be set by the control and/or regulating device to the conveying speed, which the old material web has at the time of connecting the trailing end of the first material web. However, this setting may be done before the actual connection. It is decisive, however, that following adjustment, the conveying speeds of the first and second material webs are only changed synchronously and preferably not anymore. The mutual setting includes speed synchronization, as well as the placement of the web start on a support, upon which the end of the first material web also rests. In particular, this will be the guiding area of the conveying device. The setting is performed such that the distance between the trailing end and the web start exceeds 0 mm. This means in particular that overlapping of both material webs is excluded. Overlapping would mean excessive, typically double material thickness, whereby the material needed for permanently bonding both webs, e.g., adhesive or tape, additionally adds to the thickening. Such a bulging point is capable of disturbing the operation of a processing machine. However, due to the lack of overlap, the unwinding apparatus according to the invention provides a connection point for easier processing in a processing machine and avoiding malfunctions there.

When performing or immediately following the setting of the trailing end and the web start, both material webs are connected to one another with a connecting element, whereby, e.g., adhesive tape may be used as a connecting element. The guiding area of the conveying device can provide the necessary counteracting force during the connection process and thus serve as a counter-layer.

According to the invention, the adjustment and/or connection take place at a conveying speed exceeding 0 meters per minute (m/min), preferably exceeding 50 m/min, in particular, of exceeding 100 m/min. In particular, this means that the roll change does not take place at standstill. Thus, the processing machine can be supplied continuously with the material web, so that it may continue producing without or with few restrictions.

A preferred embodiment of the invention in particular provides that the conveying path of the material web downstream of the conveying device is not changed during the connecting process. In other words, the apparatus is designed to be free of buffering. Such a buffer, which is often designed as a dancer apparatus, could allow for connecting the materials webs at standstill without having to slow down or stop the further processing machine, however, such a buffer is space consuming, expensive and maintenance-prone. Furthermore, such a buffer give rise to different web tensions, which may be highly disadvantageous for many applications, in that this may change the properties of the material webs, in particular if the web is or includes a plastic foil.

An advantageous embodiment provides a conveying device, in which the separator is integrated. In the rest position, the separator may be designed as a separating knife. In the resting position, the separator may be integrated within the conveying device, in particular within the roller body of a conveying roller, and in its functional position project from the outer surface of the conveying device, thereby causing the separation of a material web. This is a particularly space-saving arrangement for the separator. Such a conveying device may additionally include means for fixating the first and/or second material web in the guiding area. Such means may be holes to which vacuum may be applied in the guiding area of the conveying device, e.g., suction holes. However, electrodes ensuring an electrostatic charge of the web may also be provided. An electrostatic attraction force between the material web and the guiding area can thus be created, something that is particularly effective for plastic webs. In a further alternative embodiment, below nozzles may be provided, with which a gas flow can be directed onto the material web in order to apply a force in the direction of the guiding area.

Furthermore, a braking device can act on the first roll in order to delay the end of the first material web following separation, such that it will not enter the area, in which the connection of the first material web to the second material web takes place. For this purpose, the optional drive can be operated as a generator (electric brake), and/or a mechanical brake may be provided, which preferably acts on the winding axle receiving the roll.

In a further embodiment, the separating cut is preferably extending perpendicularly to the transport direction of the material web, such that the trailing end and the web start, in particular if the latter also is an edge extending perpendicularly to the conveying direction, is at a constant distance that positively affects the tensile forces during further transport of the material webs. Different tensile forces and/or web tensions in the transverse direction are thus minimized, or even completely prevented.

As a whole, the first material web can be severed and the resulting trailing end held in the guiding area.

If the new web start of the second material web is now placed at a distance greater than 0 mm in the guiding area, fixation of this web start in the guiding area must be ensured, as the contact pressure of a positioning apparatus is available therefor only for a brief moment. One embodiment may provide a double-sided adhesive tape, whose adhesive surfaces have different adhesive forces. The side with the lower adhesive force can be used initially to hold the web start on the roll, especially when the roll is rotating. The surface with the higher adhesive force can be placed at the web start, such that a first surface section of this surface adheres to the web start and a second surface section exposed and during setting is moved to the trailing end for connection therewith. During further transport of the now connected material webs, the web start of the second material web separates from the roll, as the corresponding adhesive force is less than the adhesive force of the side, which now connects the two webs together. Additionally or alternatively, the conveying device may be designed such that after mutual adjustment of the trailing end and the web start, the latter is held on the conveying device by retaining forces. Here too, holes, to which vacuum may be applied, are conceivable in the casing of the conveying device, which are used for fixation by suction of at least the web start. Blow nozzles, through which a pressurized gas escapes and wherein the gas flow is directed toward the web start, are also conceivable. Again, electrodes for electrostatically charging the web in order to create an electrostatic attraction force are also conceivable here. For the above purpose, mechanical aids such as holding forceps may also be provided.

In case an adhesive strip for preparing the roll change is not already applied to the web start, a fastener application device can be provided within the unwinding apparatus, in particular an adhesive tape application device. Thus, a connecting element may be applied, when the trailing end and the web start are already mutually set and still in the guiding area.

In a further embodiment of the invention, a further conveying device for the new material web may be provided, and with which the new material web may be guided before setting to the trailing end. Moreover, this embodiment provides a further separator for creating a web start. This further conveying device likewise includes a guiding area. After setting up the web start, the further conveying device may be placed against the first conveying device, whereby the web start may be transferred to the first conveying device. This transfer process may thereby be supported by at least one apparatus for repelling the web start of the further conveying device. This may be, e.g., openings on the outer surface of the conveying device, to which overpressure may be applied, such that the web start separates from the said guiding area of the second conveying device.

The object mentioned in the introduction is likewise achieved by the features of claim 8. Accordingly, a method for changing a roll and connecting a new material web to an end of an old material web, in which:

- A wound first material web is unwound from a first roll;
- The first material web is guided via a conveying device, in particular a conveying roller, in a guiding area at a conveying speed;
- The new material web is supplied from a second roll;
- The second roll is rotationally driven by a drive device;
- The first material web is severed by a separator to create a trailing end in the guiding area or upstream of the guiding area;
- The trailing end and a web start of the second material web are adjusted via a control and/or regulating device, such that the trailing end and the web start are at a distance greater than 0 mm from one another, and in particular free of overlap;
- The trailing end and the web start of the new material web in the guiding area of the conveying device may be connected to one another with a connecting element; and
- The conveying speed of the trailing end and the web start in the guiding area exceeds 0 meters per minute.

Figure 2:
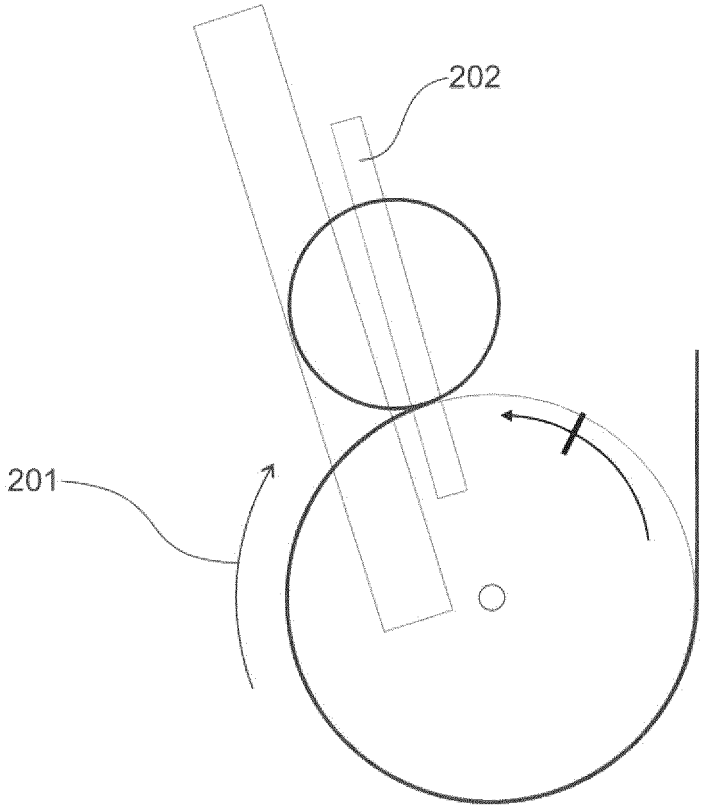
Figure 3:
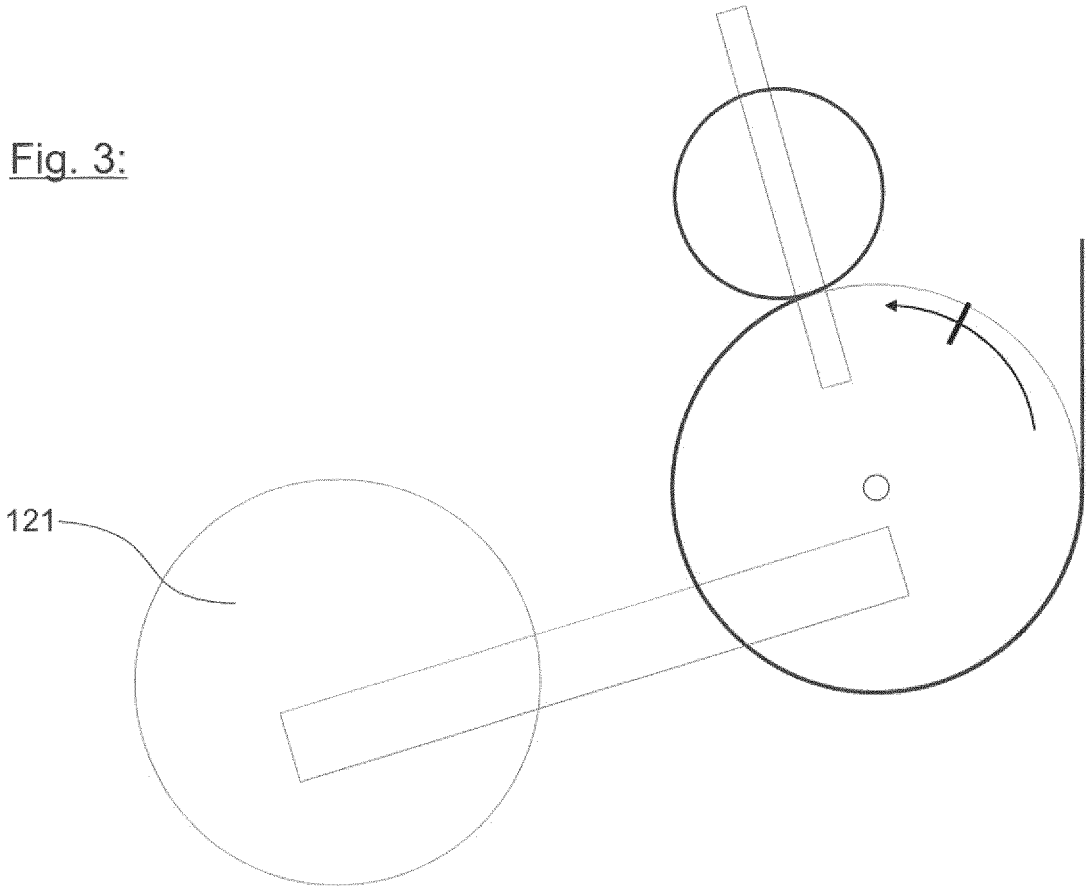
Figure 4:
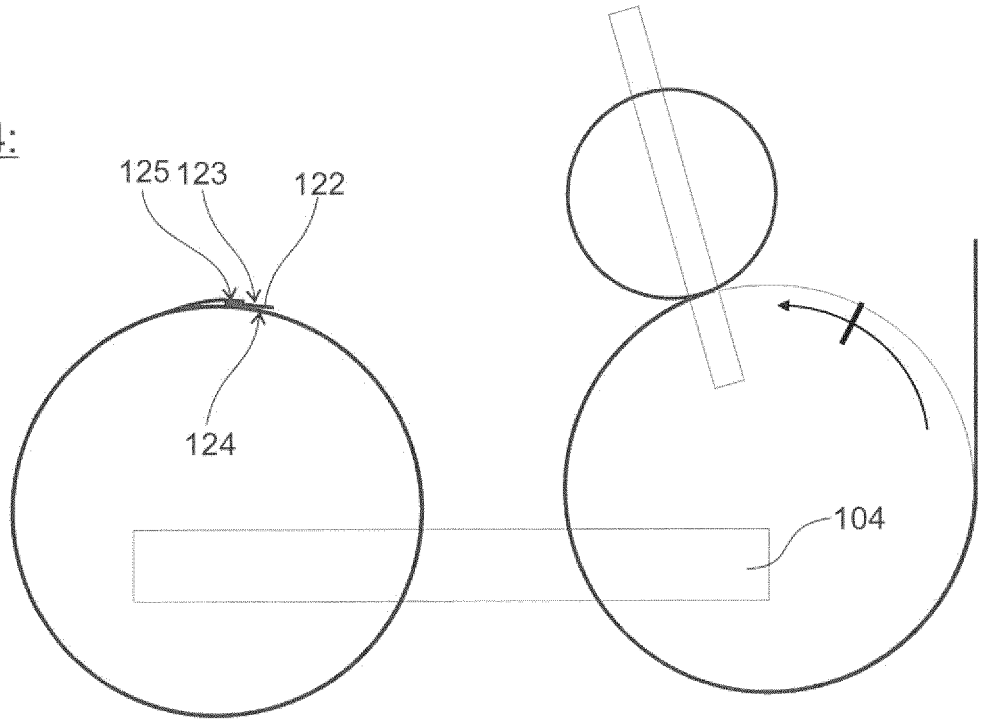
Figure 5:
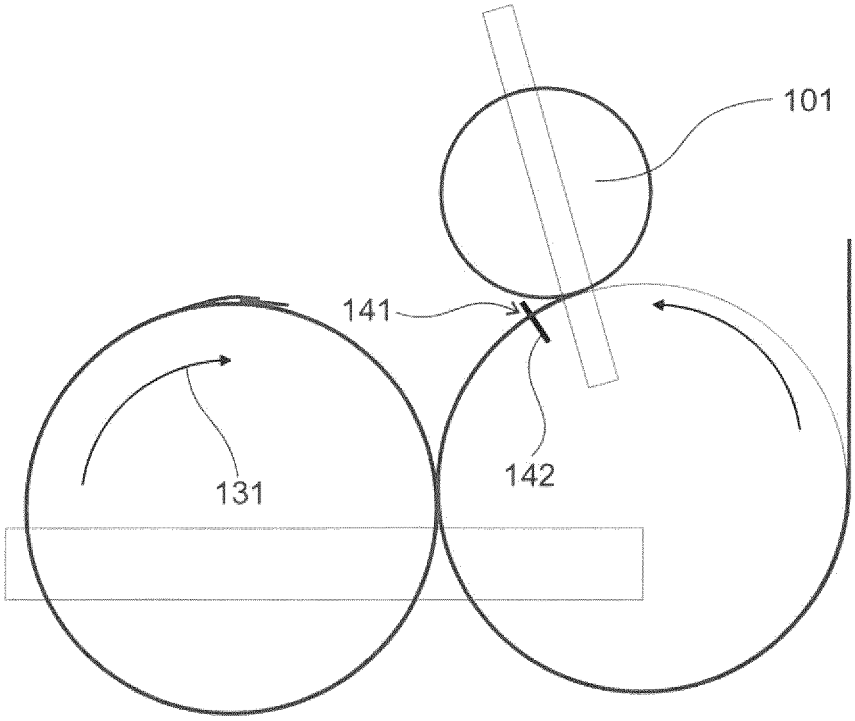
Figure 6:
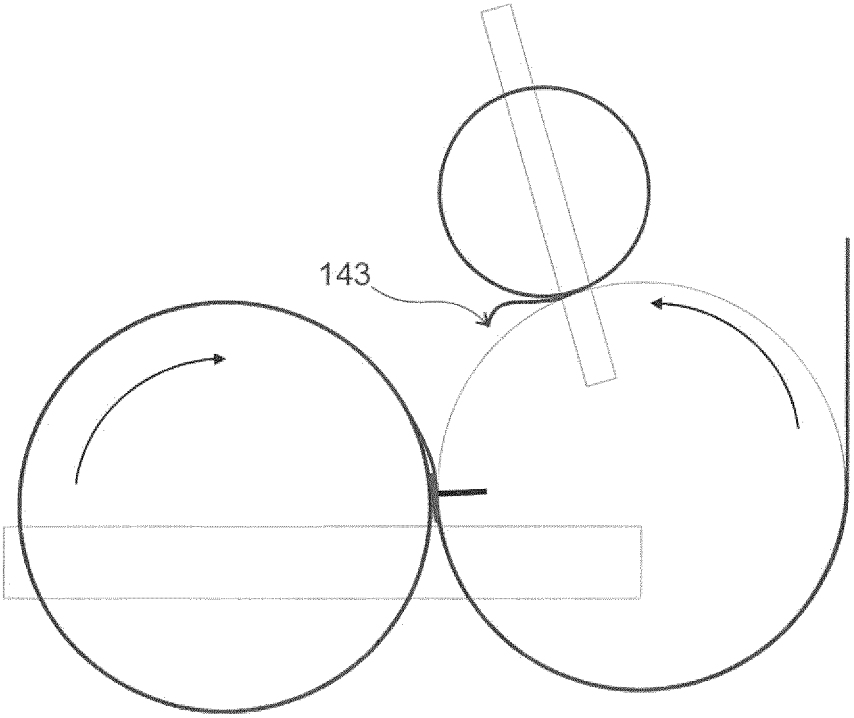

Further advantages, features and details of the invention will become apparent from the following description, which explains various exemplary embodiments in detail with reference to the figures. The features mentioned in the claims and the description may be essential to the invention individually or in any combination. In the context of the entire disclosure, features and details described in connection with the method according to the invention naturally also apply to the unwinding apparatus according to the invention and vice versa, such that mutual reference is always made or can be made to the individual aspects of the invention with respect to the disclosure. The individual figures show:

FIG. 1 A schematic diagram of an unwinding apparatus according to the invention in the unwinding phase FIG. 2 A schematic diagram of an unwinding apparatus according to the invention with a first roll shifted to the change position FIG. 3 A schematic diagram of an unwinding apparatus according to the invention with a first roll shifted to the change position FIG. 4 A schematic diagram of an unwinding apparatus according to the invention with a second roll prepared for a roll change FIG. 5 A schematic diagram of an unwinding apparatus according to the invention with an accelerated second roll FIG. 6 A schematic diagram of an unwinding apparatus according to the invention, whereby the web end of the first roll and the web start of the second roll reach the contact point.

Figure 7:
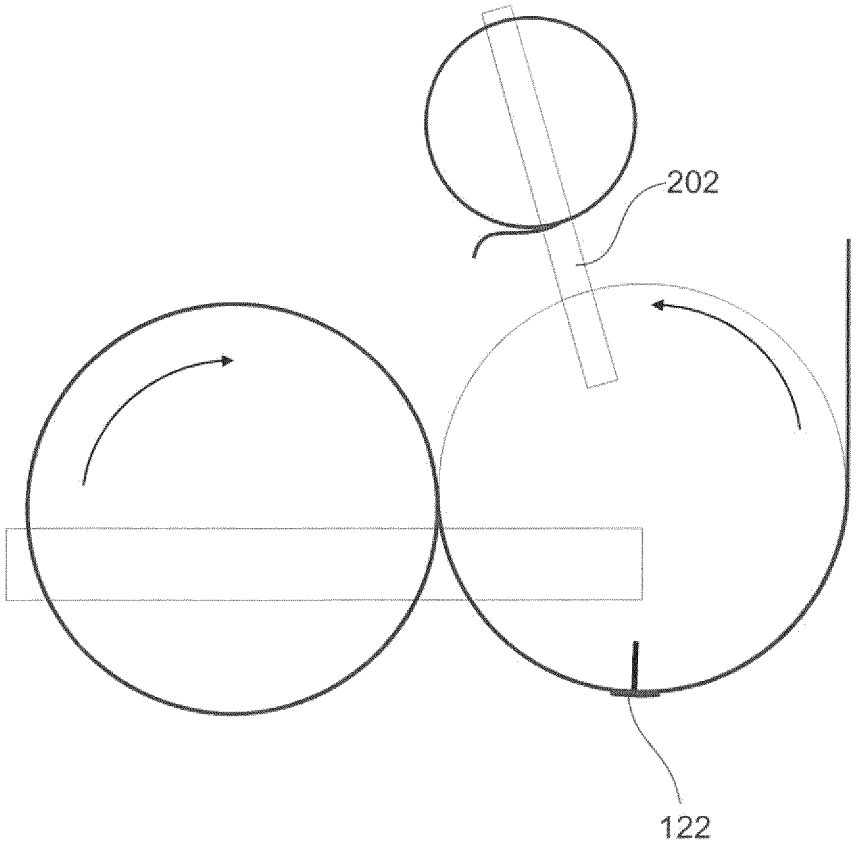

FIG. 7 A schematic diagram of an unwinding apparatus according to the invention, whereby the first winding is conveyed away.

FIG. 1 is a schematic diagram of an unwinding apparatus 100 according to the invention during the unwinding phase, in which a roll 101 is initially situated in the unwinding apparatus 100. The material web 102 is pulled off from the roll 101 and passes over a contact roller 103, against which preferably the winding 101 is positioned. For this purpose, the winding 101 may be rotatably mounted on slides, not shown, whereby the slides may slide on rails relative to the contact roller 103. The rails are connected to pivoting arms 104 that are pivotable about the axis of rotation 105 of the contact roller 103, such that the roll 101 may assume different angular positions for the contact roller 103. During the normal unwinding process shown, the roll 101 rotates in the direction of the arrow 111 and the contact roller 103 in the direction of the arrow 113, i.e., they rotate in opposite directions. The conveying direction of the material web 102 is indicated by the arrow 112.

FIG. 2 now shows the situation, in which the roll 101 was unwound to a small roll size, whereby only so much material web is on the roll, such that only a small amount is available at the end of the change process as a safety stock. In the situation shown, the swivel arms 104 were pivoted against the direction of rotation of the contact roller 103 in the direction of the arrow 201, such that the roll 101 can be transferred to the support arms 202. In this position, which may be designated the second reel position, the roll is still being unwound.

FIG. 3 now shows that the rolls remains in the second unwinding position. The swivel arms 104 are now being pivoted back. The position, which the swivel arms assume after pivoting back, may be the unwinding position, as shown in FIG. 1, or also, as shown, a receiving position for receiving a new roll 121. This position is preferably lowered relative to the unwinding position according to FIG. 1 in order not having to lift the roll with a crane or forklift.

FIG. 4 now shows the situation according to FIG. 3, but with the swivel arms 104 pivoted back into the unwinding position. FIG. 4 shows yet another advantageous detail. The new roll 121 is prepared for a roll change in such a way that a double-sided adhesive tape 122 is glued on in the area of transition from the first material web layer to the second material web layer of the roll 121 in the transverse direction with its lower surface 124. The web start 125 with its rear side is glued onto a partial surface of the upper surface 123 of the adhesive tape 122. The part of the upper surface 123 of the adhesive tape 122 not covered by the web start 125 initially remains exposed.

FIG. 5 now shows that the second roll has been set in rotation. This is indicated by the arrow 131. During the acceleration phase, the second winding 121 was synchronized with the contact roller 103 with respect to the peripheral speed and the angular position, whereby the web start 125 impacts the contact roller 103 at or shortly after the position 141 of the separating knife 142 of the contact roller 103. "Shortly after" preferably means an area greater than 0 millimeters (mm) and up to 30 mm, in particular up to 20 mm, and preferably up to 10 mm FIG. 5 also shows that having passed the roll 101, the separating knife was moved out of the peripheral surface of the contact roller in order to sever the material web 102. Immediately after applying the separating cut, the separating knife 142 is retracted again so as not to damage the roll 121. Before the web end of the material web 102 created now by the separating cut passes the contact point between the contact roller 103 and the roll 121, the roll 121 was already moved up to the contact roller 103 by the above-described slide rail system in order to make contact therewith.

FIG. 6 shows the web start of the new roll 121 reaching the contact line almost simultaneously with the web end of the material web 102, whereby the exposed area of the adhesive tape 122 is placed on the web end, such that the end of the material web 102 is connected with the web start of the new roll. The double-sided adhesive tape 122 has an upper surface 123 with greater adhesion with respect to the material of the material webs than the adhesion of the lower surface 124 of the adhesive tape. Thus, it can be ensured that upon connection of the two material webs, the adhesive tape also separates from the transition between the first and second material layers of the reel 121. In order to make the described process even safer, devices, which act on the web end and/or the web start with an additional force in the direction of the surface of the contact roller, may be provided. Preferably, for this purpose, holes to which vacuum may be applied, e.g., suction holes, may be provided in the surface of the contact roller. Such openings are not shown in FIG. 6.

Before the web end 143 of the first roll 101 created by the severing knife 142 could reach the contact line between the second roll 121 and the contact roller 103, the first roll 101 is slowed down by a braking device, not shown, such that the web end 143 is not in the area of the contact line Finally, FIG. 7 shows that the connection point, which is visible due to the adhesive tape 122, is conveyed further by the still continuing rotation of the contact roller 103, while the first roll 101 is removed from the contact roller along the support arms 202 and passed to a removal position. From there, the first roll 101 can be removed from the winding device 100. Thus, the condition in accordance with FIG. 1 has been restored, whereby the second roll 121 is now the first roll 101 for the ensuing change process.

Various elements of the apparatus according to the invention are depicted several times in the individual figures. For the sake of clarity, the same elements have been provided with reference numerals only in one or a few figures. However, the reference numerals also apply with respect to figures in which they have not been entered.

| Reference numeral list | |
|---|---|
| 100 | Unwinding apparatus |

-continued

| Reference numeral list | |
|---|---|
| 101 | Roll |
| 102 | Material web |
| 103 | Contact roller |
| 104 | Swivel arms |
| 105 | Axis of rotation |
| 111 | Arrow |
| 112 | Arrow |
| 113 | Arrow |
| 121 | New roll |
| 122 | Double-sided adhesive tape |
| 123 | Upper surface of the adhesive tape 122 |
| 124 | Lower surface of the adhesive tape 122 |
| 125 | Web start |
| 131 | Arrow I |
| 141 | Position of separating knife 142 |
| 142 | Separating knife |
| 143 | Web end |
| 201 | Arrow |
| 202 | Support arms |

The invention claimed is:

1. An apparatus for changing a roll and connecting a new material web to an end of an old material web, the apparatus comprising:

a first roll, whose wound-up, first material web can be unwound;

a conveying device over which the first material web may be guided in a guiding area at a conveying speed;

a second roll, with which the new material web may be supplied;

a drive device for rotationally driving the second roll;

a severing device for severing only the first material web, with which the material web may be severed in order to create a trailing end in the guiding area or upstream of the guiding area; and a control and/or regulating device for mutual adjustment of the trailing end and the web start of the new material web such that the trailing end and the web start are at a distance greater than 0 mm from one another and are free of overlap, wherein the mutual adjustment comprises synchronization of the trailing end and the web start of the new material web by setting the web start of the new material web to the conveying speed and aligning the angular position of the web start of the new material web relative to the trailing end, wherein:

the trailing end and the web start of the new material web in the guiding area of the conveying device may be connected to one another with a connecting element, and the conveying speed of the trailing end and the web start in the guiding area exceeds 0 meters per minute.

2. An apparatus according to claim 1, wherein the trailing end and the web start are at a distance of less than 30 mm.

3. The apparatus according to claim 2, wherein the trailing end and the web start are at a distance of less than 20 mm from one another.

4. The apparatus according to claim 2, wherein the trailing end and the web start are at a distance of less than 10 mm from one another.

5. An apparatus according to claim 1, wherein the adjustment and/or connection take place at a conveying speed exceeding 0 meters per minute (m/min).

6. An apparatus according to claim 5, wherein the adjustment and/or connection take place at a conveying speed exceeding 50 m/min.

7. An apparatus according to claim 5, wherein the adjustment and/or connection take place at a conveying speed exceeding 100 m/min.

8. An apparatus according to claim 1, wherein the apparatus is designed as buffer-free.

9. An apparatus according to claim 1, wherein the conveying device is a conveying roller.

10. The apparatus according to claim 9, wherein the conveying roller is a contact roller.

11. An apparatus according to claim 1, wherein the severing device is arranged within the conveying device and can be extracted for separation from the surface upon which the material web rests, whereby a separating cut takes place.

12. An apparatus according to claim 1, wherein a braking device is provided with which the first roll can be slowed down.

13. A method for changing a roll and connecting a new material web to an end of an old material web, whereby a wound-on, first material web is unwound from a first roll, the first material web is guided via a conveying device, in particular a conveying roller, in a guiding area at a conveying speed, the new material web is supplied from a second roll, the second roll is rotationally driven by a drive device, the first material web is severed by a separator in order to create a trailing end in the guiding area or upstream of the guiding area, and the trailing end and a web start of the new material web are mutually adjusted via a control and/or regulating device such that the trailing end and the web start are at a distance greater than 0 mm from one another and free of overlap, wherein the mutual adjustment comprises synchronization of the trailing end and the web start of the new material web by setting the web start of the new material web to the conveying speed and aligning the angular position of the web start of the new material web relative to the trailing end, wherein:

the trailing end and the web start of the new material web in the guiding area of the conveying device may be connected to one another with a connecting element, and the conveying speed of the trailing end and the web start in the guiding area exceeds 0 meters per minute.

* * * * *